US007711292B2

(12) United States Patent
Nagae et al.

(10) Patent No.: US 7,711,292 B2
(45) Date of Patent: May 4, 2010

(54) TONER CARTRIDGE, AND SHUTTER STRUCTURE FOR THE SAME

(75) Inventors: Rumi Nagae, Osaka (JP); Tohru Nakayama, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 0 days.

(21) Appl. No.: 12/473,277

(22) Filed: May 28, 2009

(65) Prior Publication Data

US 2009/0232547 A1 Sep. 17, 2009

Related U.S. Application Data

(63) Continuation of application No. 11/277,945, filed on Mar. 30, 2006, now Pat. No. 7,555,250.

(30) Foreign Application Priority Data

Mar. 30, 2005 (JP) ..... 2005-099181
Jan. 24, 2006 (JP) ..... 2006-014961

(51) Int. Cl.
*G03G 15/08* (2006.01)

(52) U.S. Cl. ..... 399/260; 399/262

(58) Field of Classification Search ..... 399/260, 399/262, 119, 258

See application file for complete search history.

(56) References Cited

U.S. PATENT DOCUMENTS

2004/0131391 A1 7/2004 Nagashiro
2005/0123322 A1 6/2005 Okamoto et al.

FOREIGN PATENT DOCUMENTS

JP 2004-205587 A 7/2004

*Primary Examiner*—David M Gray
*Assistant Examiner*—Erika Villaluna
(74) *Attorney, Agent, or Firm*—Shinjyu Global IP

(57) ABSTRACT

A toner cartridge includes a container main body includes a toner outlet, a shutter mechanism for opening and closing the toner outlet, a lever for operating the shutter mechanism, a lever locking mechanism, a lock releasing mechanism, and a prevention mechanism. The lever locking mechanism locks the lever so as to be inoperative while the toner outlet is closed. The lock releasing mechanism unlocks the lever locked by the lever locking mechanism in conjunction with installment of the container main body into the image forming device. The prevention mechanism prevents the container main body from being taken out of the image forming device while the container main body is installed in the image forming device, and the lever operates to open the toner outlet.

10 Claims, 11 Drawing Sheets

TONER CARTRIDGE, AND SHUTTER STRUCTURE FOR THE SAME

CROSS-REFERENCE TO RELATED APPLICATIONS

This application is a continuation application of U.S. patent application Ser. No. 11/277,945 filed on Mar. 30, 2006. The entire disclosure of U.S. patent application Ser. No. 11/277,945 is hereby incorporated herein by reference.

This application claims priorities to Japanese Patent Application Nos. 2005-099181 and 2006-014961. The entire disclosure of Japanese Patent Application Nos. 2005-099181 and 2006-014961 are hereby incorporated herein by reference.

BACKGROUND OF THE INVENTION

1. Field of the Invention

The present invention relates to a toner cartridge, and more particularly relates to a toner cartridge that is releasably installed in an image forming device. Furthermore, the present invention relates to a shutter structure of the toner cartridge, particularly to a shutter structure for opening and closing a toner outlet of a toner cartridge that is removably installed in an image forming device.

2. Background Information

An image forming device such as a copying machine includes a toner cartridge to supply toner to a developing unit. The toner cartridge is formed with a toner outlet at the bottom thereof, and has a shutter mechanism to open and close the toner outlet. The toner cartridge is removably installed in the main body of the image forming device. A toner conveyance screw is provided inside the toner cartridge, and is rotatably driven in order to discharge the toner contained in the toner outlet and supply the toner to the developing unit.

It is undesirable for the toner contained in the toner cartridge to leak before the toner cartridge is installed into the image forming device main body, after the toner cartridge is released from the device main body, or during the operation of installation or removal. Therefore, a toner cartridge disclosed in Japan Patent Application Publication 2004-205587 has been proposed.

The toner cartridge is composed of a container main body having a toner outlet, a shutter member, a lever member, and a lock member. When the lever member is set in a closing position, the lever member deforms an elastic portion of the lock member to urge the lock member into the locking position. Meanwhile, when the container main body is attached to the image forming device main body, the lock member is shifted into a releasing position to allow the lever member to pivot from its closing position to its opening position.

In the toner cartridge shown in the unexamined patent publication, the lever member, which operates a shutter member to open or close the toner outlet, is locked or unlocked by means of the installation or removal of the toner cartridge into or out of the image forming device main body. Accordingly, when the toner cartridge is not installed in the image forming device main body, it is possible to prevent the toner outlet from shifting into the opening position, thereby preventing the leakage of toner.

However, while the toner cartridge is installed in the image forming device main body and the toner outlet is in the opened state, operating errors such as taking the toner cartridge out of the image forming device main body could cause the toner to leak from the toner outlet.

In view of the above, it will be apparent to those skilled in the art from this disclosure that there exists a need for an improved toner cartridge that can control the opening and closing of the toner outlet with a simple structure, and prevent the leakage of toner due to operating errors. This invention addresses this need in the art as well as other needs, which will become apparent to those skilled in the art from this disclosure.

SUMMARY OF THE INVENTION

A toner cartridge according to a first aspect of the present invention is removably attached to an image forming device. The toner cartridge comprises a container main body, a shutter mechanism, a lever, a lever locking mechanism, a lock releasing mechanism and a prevention mechanism. The container main body contains toner and has a toner outlet. The shutter mechanism opens or closes the toner outlet of the container main body. The lever is rotatably supported by the container main body for operating the shutter mechanism. The lever locking mechanism locks the lever to be inoperative while the toner outlet is closed by the shutter mechanism. The lock releasing mechanism unlocks the lever which is locked by the lever locking mechanism in conjunction with installation of the container main body to the image forming device. The prevention mechanism prevents the container main body from being taken out of the image forming device while the container main body is installed in the image forming device and the lever operates the shutter mechanism to open the toner outlet.

When the toner cartridge is not installed in the image forming device, the toner outlet is closed by the shutter mechanism. When the toner outlet is closed, the lever operating the shutter mechanism is locked. When the toner cartridge is installed into the image forming device, the lever is unlocked in conjunction with the installation. Accordingly, in this state, the lever can be manipulated to operate the shutter mechanism to open the toner outlet. As a result, the toner inside the container main body is supplied to the image forming device. In addition, while the container main body is installed in the image forming device and the shutter mechanism is operated by the lever to open the toner outlet, the container main body is prevented from being taken out of the image forming device.

In this case, since the lever for operating the shutter mechanism is locked while the toner cartridge is not installed in the image forming device and the toner outlet is closed, the lever can not move to open the toner outlet so that the leakage of toner is prevented. In addition, since the lever is unlocked in conjunction with installation of the toner cartridge into the image forming device, it is possible smoothly open the toner outlet. Furthermore, since the container main body is prevented from being taken out of the image forming device while the toner outlet is opened, the container main body cannot be taken out with the toner outlet open, thereby preventing the leakage of toner.

A toner cartridge according to a second aspect of the present invention is the cartridge of the first aspect, wherein the lever locking mechanism has a first engaging portion formed on a part of the lever, and an engaging portion formed on the container main body with which the first engaging portion on the lever is engaged.

In this cartridge, the first engaging portion on the lever and the engaging portion on the container main body are engaged with each other, whereby the lever is locked to be inoperative. As a result, the lever locking mechanism is achieved with a simple structure.

A toner cartridge according to a third aspect of the present invention is the cartridge of the second aspect. The cartridge further comprises a slide shutter provided slidably in the path of insertion of the toner cartridge for opening and closing the toner outlet together with the shutter mechanism. The lock releasing mechanism is composed of the slide shutter. The slide shutter slides toward the lever to move the first engaging portion on the lever, in conjunction with installation of the container main body to the image forming device, thereby releasing the engagement between the first engaging portion on the lever and the engaging portion on the container main body.

In this cartridge, when the container main body is installed into the image forming device, the slide shutter slides toward the lever to move the first engaging portion on the lever in conjunction with the installation, thereby releasing the engagements between the first engaging portion on the lever and the engaging portion on the container main body. In this case, since the slide shutter is utilized to realize a lock releasing mechanism, the structure is simple.

A toner cartridge according to a fourth aspect of the present invention is the cartridge of the first aspect, wherein the prevention mechanism includes a second engaging portion on the lever which is formed on a part of the lever. The second engaging portion on the lever is engaged with a part of the image forming device to prevent the container main body from being taken out of the image forming device while the toner outlet is opened.

In this cartridge, since the second engaging portion on the lever is engaged with a part of the image forming device while the toner outlet is opened, the container main body can not be taken out of the image forming device. In this case, since a part of the lever realizes the prevention mechanism, a prevention mechanism is implemented without any special components, thereby simplifying the structure.

A toner cartridge according to a fifth aspect of the present invention is the cartridge of the first aspect, wherein the lever locking mechanism includes a gear being rotatable around an axis different from a pivoting axis of the lever for rotating in conjunction with the shutter mechanism and the lever, and a rotation prevention mechanism for preventing the rotation of the gear.

In this toner cartridge, the gear rotatable around the axis different from the pivoting axis of the lever is provided, and the gear is rotated in conjunction with the shutter mechanism and the lever. The rotation prevention mechanism prevents the rotation of the gear to lock the lever.

In this toner cartridge, the pivoting of the lever and the rotation of the gear are associated, if the ratio of the rotational speed (gear ratio) between them is suitably set, it is possible to set suitably the relationship between the pivoting angle of the lever and the rotation angle of the shutter mechanism associated with the gear. As a result, the pivoting angle of the lever, i.e., the angle of inclination can be set relatively small to avoid interference of the lever with other members, for example.

A toner cartridge according to a sixth aspect of the present invention is the cartridge of the fifth aspect, wherein the rotation prevention mechanism includes a lock plate having an engagement hole, the lock plate being coaxial with the gear and attached to the gear unrotatably, and a protrusion formed on the container main body which can be engaged with the engagement hole of the lock plate.

In this cartridge, when the engagement hole of the lock plate and the protrusion of the container main body are engaged with each other, the rotation of the gear is prohibited and the lever is locked. As a result, a rotation prevention mechanism is realized with a simple structure.

A toner cartridge according to a seventh aspect of the present invention is the cartridge of the sixth aspect. The cartridge further comprises a slide shutter provided slidably in the path of insertion of the toner cartridge for opening and closing the toner outlet together with the shutter mechanism. The lock releasing mechanism is composed of the slide shutter. The slide shutter slides toward the lock plate to elastically deform a part of the lock plate where the engagement hole is formed, in conjunction with installation of the container main body to the image forming device, thereby releasing the engagement between the engagement hole of the lock plate and the protrusion.

In this cartridge, when the container main body is installed into the image forming device, the slide shutter slides toward the lock plate to deform the lock plate elastically in conjunction with the installation, thereby releasing the engagement between the engagement hole of the lock plate and the protrusion of the container main body. In this case, since the slide shutter is utilized to realize a lock releasing mechanism, the structure is simple.

A toner cartridge according to an eighth aspect of the present invention is the cartridge of the fifth aspect, the prevention mechanism includes a slide plate which slides in conjunction with the pivoting of the lever. The slide plate having an engaging portion for being engaged with a part of the image forming device to prevent the container main body from being taken out of the image forming device while the toner outlet is opened.

In this cartridge, when the toner outlet is opened, the engaging portion of the slide plate is engaged with a part of the image forming device. Consequently, the container main body can not be taken out of the image forming device.

A shutter structure of a toner cartridge according a ninth aspect of the present invention opens or closes a toner outlet of the toner cartridge which is removably attached to an image forming device. The shutter structure comprises a shutter mechanism, a lever, a lever locking mechanism, a lock releasing mechanism, and a prevention mechanism. The shutter mechanism opens or closes the toner outlet. The lever is rotatably supported by the container main body of the toner cartridge for operating the shutter mechanism. The lever locking mechanism locks the lever to be inoperative while the toner outlet shutter is closed by the shutter mechanism. The lock releasing mechanism unlocks the lever locked by the lever locking mechanism in conjunction with installation of the container main body to the image forming device. The prevention mechanism prevents the container main body from being taken out of the image forming device while the container main body is installed in the image forming device and the lever operates the shutter mechanism to open the toner outlet.

A shutter structure of a toner cartridge according to a tenth aspect of the present invention is the structure of the ninth aspect, wherein the lever locking mechanism includes a first engaging portion formed on a part of the lever, and an engaging portion formed on the container main body with which the first engaging portion on the lever is engaged.

A shutter structure of a toner cartridge according to an eleventh aspect of the present invention is the structure of the tenth aspect. The shutter structure further comprises a slide shutter provided slidably in the path of insertion of the toner cartridge for opening or closing the toner outlet together with the shutter mechanism. The lock releasing mechanism includes the slide shutter and a step portion. The step portion is formed on the image forming device, which abuts against the slide shutter to slide the slide shutter toward the lever in order to move the first engaging portion on the lever, in conjunction with installation of the container main body to the image forming device, thereby releasing the engagement between the first engaging portion on the lever and the engaging portion on the container main body.

A shutter structure of a toner cartridge according to a twelfth aspect of the present invention is the structure of the ninth aspect, wherein the prevention mechanism includes a second engaging portion formed on a part of the lever, and an engaging portion formed on the image forming device. The engaging portion on the image forming device is engaged with the second engaging portion on the lever to prevent the container main body from being taken out of the image forming device while the toner outlet is opened.

A shutter structure of a toner cartridge according to a thirteenth aspect of the present invention is the structure of the ninth aspect, wherein the lever locking mechanism includes a gear being rotatable around an axis different from a pivoting axis of the lever for rotating in conjunction with the shutter mechanism and the lever, and a rotation prevention mechanism for preventing the rotation of the gear.

A shutter structure of a toner cartridge according to a fourteenth aspect of the present invention is the structure of the thirteenth aspect, wherein the rotation prevention mechanism includes a lock plate having an engagement hole, the lock plate being coaxial with the gear and attached to the gear unrotatably, and a protrusion formed on the container main body which can be engaged with engagement hole of the lock plate.

A shutter structure of a toner cartridge according to a fifteenth aspect of the present invention is the structure of the fourteenth aspect. The structure further comprises a slide shutter provided slidably in the path of insertion of the toner cartridge for opening or closing the toner outlet together with the shutter mechanism. The lock releasing mechanism includes the slide shutter and a step portion. The step portion is formed on the image forming device, which abuts against the slide shutter to move the slide shutter toward the lock plate in order to elastically deform a part of the lock plate where the engagement hole is formed, in conjunction with installation of the container main body to the image forming device, thereby releasing the engagement between the engagement hole of the lock plate and the protrusion.

A shutter structure of a toner cartridge according to a sixteenth aspect of the present invention is the structure of the thirteenth aspect, wherein the prevention mechanism includes a slide plate and an engaging portion formed on the image forming device. The slide plate slides in conjunction with the pivoting of the lever and has an engaging portion. The engaging portion on the image forming device is engaged with the engaging portion on the slide plate to prevent the container main body from being taken out of the image forming device while the toner outlet is opened.

As described above, in the present invention, it is possible to control the opening and closing of the toner outlet with a simple structure and to prevent the leakage of toner due to an operating error.

These and other objects, features, aspects and advantages of the present invention will become apparent to those skilled in the art from the following detailed description, which, taken in conjunction with the annexed drawings, discloses a preferred embodiment of the present invention.

BRIEF DESCRIPTION OF THE DRAWINGS

Referring now to the attached drawings which form a part of this original disclosure.

DETAILED DESCRIPTION OF THE PREFERRED EMBODIMENTS

Selected embodiments of the present invention will now be explained with reference to the drawings. It will be apparent to those skilled in the art from this disclosure that the following descriptions of the embodiments of the present invention are provided for illustration only and not for the purpose of limiting the invention as defined by the appended claims and their equivalents.

First Embodiment

Overall Structure

Figure 1:
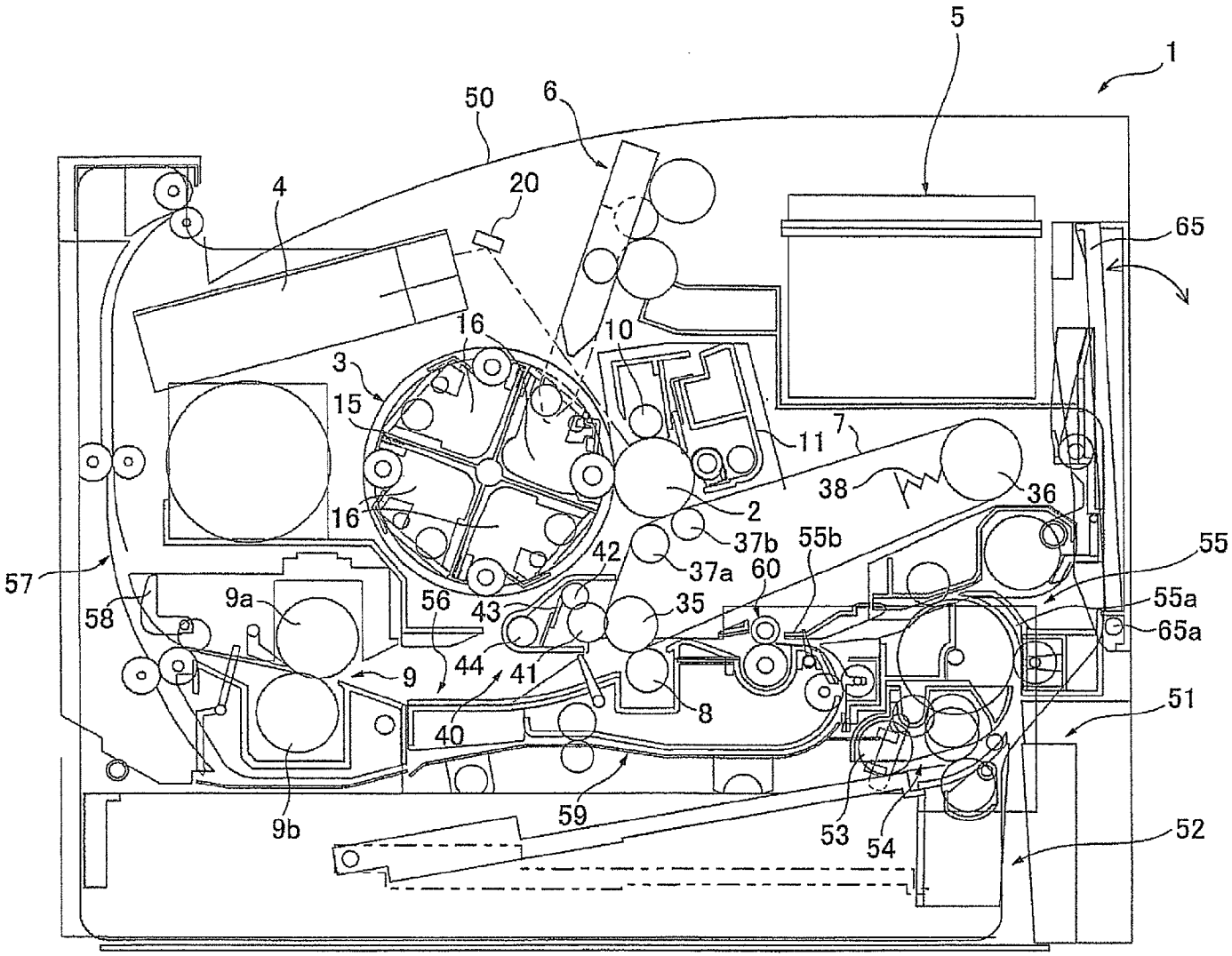
FIG. 1 is a schematic structural view of a color printer according to one embodiment of the present invention.

FIG. 1 shows a color printer 1 as an image forming device employing a toner cartridge according to an embodiment of the present invention. FIG. 1 shows the locations of each of the components in the color printer 1, with some of the details of each of the components omitted.

The color printer 1 is connected to a device, such as a computer for example, not shown in the figure, and is capable of printing a color image onto a sheet based on image data received from the computer. Note that the right hand side of this color printer 1 shown in FIG. 1 is where an operator operates the color printer 1. The right hand side is hereinafter referred to as the "front side", where the left hand side thereof is hereinafter referred to as the "rear side".

The color printer 1 includes a photosensitive drum 2, a rotary developing unit 3, a laser unit 4 as an exposure unit, a toner storage unit 5, a toner supply unit 6, an intermediate transfer belt 7, a secondary transfer roller 8, and a fixing unit 9.

The photosensitive drum 2 has a surface on which an electrostatic latent image is formed, and is rotatably mounted substantially in the center of the device. The rotational shaft of the photosensitive drum 2 is located such that the shaft extends in a direction perpendicular to the paper surface of FIG. 1, or the "lateral direction" seen from the front side of the device. This direction is hereinafter referred to as the "lateral direction". On top of the photosensitive drum 2, a charge roller 10 is mounted for uniformly charging the surface of the photosensitive drum 2. On the other hand, adjacent to the photosensitive drum 2, a drum cleaning unit 11 is mounted for cleaning residual toner and attachments on the surface of the photosensitive drum 2.

The rotary developing unit 3 develops an electrostatic latent image formed on the photosensitive drum 2 with each color toner. The rotary developing unit 3 is located adjacent to the photosensitive drum 2, and the center thereof is substantially the same height as the center of the photosensitive drum 2 in the vertical direction. The rotary developing unit 3 includes a rotary frame 15 and four sub rotary sub rotary developing units 16 corresponding to four color toners and supported by the rotary frame 15. The rotary frame 15 is a cylindrical member rotatable around an axis parallel with the rotational shaft of the photosensitive drum 2, and driven by a driving mechanism having a motor and gears, not shown in the figure. In addition, the rotary frame 15 is divided into quarters with four compartments by partitions extending from the center of the rotational axis radially outward. Each of the compartments accommodates each of the sub rotary developing units 16 corresponding to four color toners of yellow, cyan, magenta, and black.

The structure of the sub rotary developing units 16 are approximately the same. Each includes components such as a developing roller that comes into contact with the photosensitive drum 2, and an agitation roller for agitating the toner. In the color printer 1, the toner storage unit 5 with the toner cartridges is separated from the sub rotary developing units 16. Thus, each of the sub rotary developing units itself has a small toner capacity. Compared to a conventional device where the toner storage unit is within the developing unit, here, the size of the sub rotary developing units 16 is reduced.

The laser unit 4 is a unit that scans and exposes the photosensitive drum 2 based on image data received from the external computer. It is located above the photosensitive drum 2 and further toward the rear than the rotational shaft of the rotary developing unit 3. The inner structure of the laser unit 4 is of the same as the structure of a conventional laser unit, and comprises a laser light source, a polygon mirror, a motor for driving the polygon mirror, and so on. In addition, a reflective mirror 20 is provided in front of the laser unit 4. The laser light emitted from the laser unit 4 strikes the reflective mirror 20. It is inflected by the reflective mirror 20 and exposes the surface of the photosensitive drum 2.

The toner storage unit 5 contains toner to be supplied to each of the sub rotary developing units 16 of the rotary developing unit 3. It is located higher than the photosensitive drum 2 and on the opposite side of the laser unit 4, i.e. on the front side in the device. The toner storage unit 5 includes four cartridges arranged in a lateral direction, containing color toners of yellow, cyan, magenta, and black. The structure of the toner cartridge will be described in detail later.

Figure 2:
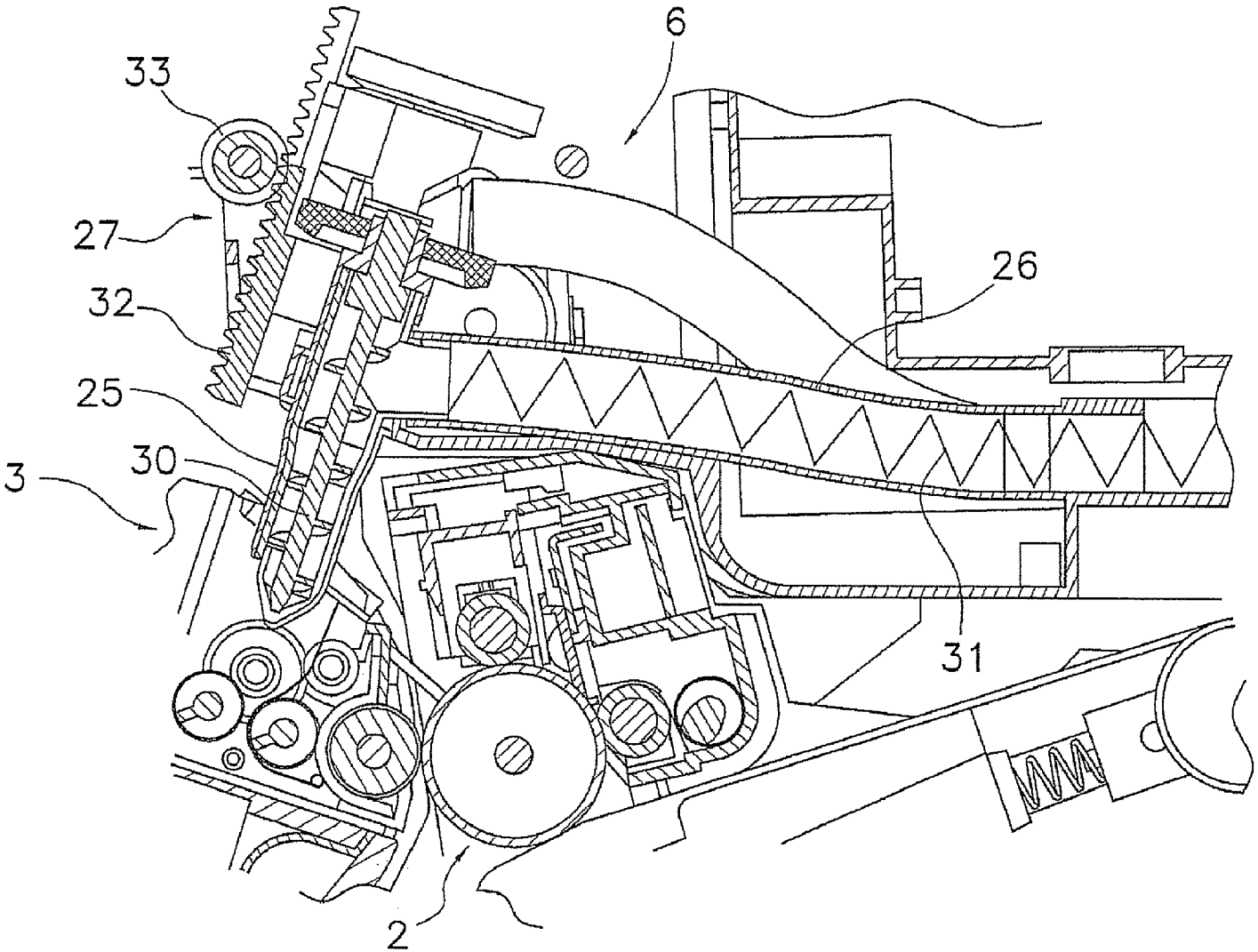
FIG. 2 is a detailed sectional structural view of a toner supply device.

The toner supply unit 6 supplies each of the toners contained in the toner storage unit 5 to the corresponding sub rotary developing units 16. It is located above the photosensitive drum 2 and in between the laser unit 4 and the toner storage unit 5. The toner supply unit 6 includes, as shown in FIG. 2, four toner supply pipes 25 that are capable of moving up and down, four conveyance pipes 26 that transport each of the color toners stored in the toner storage unit 5 to each of the corresponding toner supply pipes 25, and a drive mechanism 27 to move the toner supply pipes 25 up and down.

The toner supply pipes 25 are tilted in a position such that the upper end is toward the front side of the device and the lower end is toward the rear side of the device. Each of the toner supply pipes 25 has a tapered tip, and capable of advancing into the sub rotary developing unit 16 through a toner supply portion when the toner supply pipe 25 moves downward. Inside each of the toner supply pipes 25, a toner spiral member 30 for conveying the toner is rotatably installed.

The conveyance pipes 26 are flexible, so that the pipes 26 can follow the vertical movement of the toner supply pipes 25. Inside each of the conveyance pipes 26, a coil spring 31 is provided for conveying the toner inside each of the conveyance pipes 26 to each of the toner supply pipes 25. These coil springs 31 are rotated by a drive mechanism, not shown in the figures.

The drive mechanism 27 includes racks 32 on the outer circumference of the toner supply pipes 25 extending in the axial direction of the pipes 25, and pinion gears 33 engaged with the racks 32. The pinion gears 33 are rotatably supported by the frame of the device and driven by motors for example, not shown in the figures. The drive mechanism 27 enables the four toner supply pipes 25 to move back and forth in a retracted position upward, and a supply position downward, so that the tip of each of the toner supply pipes 25 can be inserted into the each of the corresponding sub rotary developing units 16.

The toner images in each color formed on the photosensitive drum 2 are sequentially transferred to the intermediate transfer belt 7, located below the photosensitive drum 2 and the toner storage unit 5. The intermediate transfer belt 7 is looped around a driving roller 35 and a follower roller 36 located on the opposite ends. A pair of primary transfer rollers 37*a* and 37*b* brings a portion of the transfer belt 7, positioned opposite the photosensitive drum 2, into contact with the photosensitive drum 2. Note that the follower roller 36 is urged by a spring 38 in the direction opposite the driving roller 35 so that the intermediate transfer belt 7 is placed under a predetermined tension. In addition, the primary transfer rollers 37*a* and 37*b* are located adjacent to each other below the photosensitive drum 2, so that a portion of the transfer belt 7 in a predetermined range is in contact with the photosensitive drum 2.

A belt cleaning unit 40 for cleaning the transfer belt 7 is located on the rear side of the driving roller 35 and below the rotary developing unit 3. The belt cleaning unit 40 includes a fur brush 41 located opposite to the driving roller 35 and slides in contact with the surface of the transfer belt 7, a cleaning roller 42 located above the fur brush 41 and in contact with the fur brush 41, a blade 43 with a tip in contact with the surface of the cleaning roller 42, and a recovery spiral 44 located below the blade 43.

The secondary transfer roller 8 transfers the image on the intermediate transfer belt 7 onto a print sheet conveyed to the second transfer roller 8. It is located below the driving roller 35 and opposite the driving roller 35. Bias voltage is applied to the secondary transfer roller 8 by an energizing means, not shown in the figures, so as to transfer the image onto the print sheet.

The fixing unit 9 fixes the toner image on the print sheet by fusion. It is located below the rotary developing unit 3 and toward the rear end of the device. The fixing unit 9 includes a heating roller 9*a* having a built-in heater and a pressure roller 9*b* pressing against the heating roller 9*a* for pinching the sheet therebetween so as to convey the sheet.

A sheet receiving portion 50 is provided on the top surface of the printer 1, above the laser unit 4, the toner supply unit 6 and the toner storage unit 5, where the print sheet with the image formed is discharged. The sheet receiving portion 50 consists of a curved surface that curves gradually upward above the laser unit 4 (toward the rear end of the device) to the side of the toner storage unit 5 (toward the front end of the device), and a flat surface continuing the curved surface formed above the toner storage unit 5.

At the bottom of the device, a sheet feeding cassette 52 is provided having a stack plate in which the sheets are stacked. The sheet feeding cassette 52 is provided with a sheet feeding unit 51 (sheet dispatch unit), located at the sheet dispatch end (the right end in FIG. 1), for dispatching sheets from the sheet feeding cassette 52. The sheet feeding unit 51 includes a forward feeding roller 53 for picking up sheets on the stack plate, and a sheet feeding control mechanism 54 having a pair of rollers for sending one sheet at a time into the conveyance path. The sheet feeing control mechanism 54 prevents sheets from being fed into the conveyance path more than one at a time. The sheet feeding cassette 52 can be pulled out, in a sheet dispatch direction, i.e., from the front side of the device.

The conveyance mechanism for conveying sheets is located between the sheet feeding unit 51 and the sheet receiving portion 50. The conveyance mechanism includes a first conveyance path 55 from the sheet feeding unit 51 to the secondary transfer roller 8, a second conveyance path 56 from the secondary transfer roller 8 to the fixing unit 9, and a third conveyance path 57 from the fixing unit 9 to the sheet receiving portion 50. A branching claw 58 is provided at the exit of the fixing unit 9, and a return conveyance path 59 is provided between the branching claw 58 and the middle of the first conveyance path 55 for returning the sheet to the first conveyance path 55.

The first conveyance path 55 includes a curved path 55*a* for reversing the conveyance direction as well as conveying upward the sheet sent out from the sheet feeding cassette 52, and a straight path 55*b* extending from the curved path 55*a* to the secondary transfer roller 8. These conveyance paths are composed of guide plates and pairs of rollers for guiding and conveying the sheets. Sensors are installed at predetermined places on these conveying paths for detecting the location of the print sheet. In addition, a pair of paper stop rollers 60 is provided in the straight path 55*b* for controlling the timing of the conveyance of the sheet.

The second conveyance path 56 is substantially linear. It is composed of guide plates and pairs of rollers for guiding and conveying the print sheets, as well as sensors installed at predetermined places to detect the position of the sheet.

The third conveyance path 57 has a vertical conveyance path downstream of the branching claw 58 in the conveyance direction. Namely, the print sheet is conveyed upward in the vertical direction after passing the branching claw 58 and is discharged onto the sheet receiving portion 50. The third conveyance path 57 is also comprised of guide plates and pairs of rollers for guiding and conveying the sheets.

The return conveyance path 59 is a conveyance path which branches downward from the third conveyance path 57 at the position where the branching claw 58 is mounted, extends below the fixing unit 9, the second conveyance path 56, the secondary transfer roller 8, and the pair of the paper stop rollers 60, and extends upward to join the first conveyance path 55 upstream of the pair of the paper stop rollers 60 in the conveyance direction. Namely, the return conveyance path 59 is a conveyance path located vertically between the sheet feeding cassette 52 and the straight path 55*b* of the first conveyance path 55 as well as the second conveyance path 56. The path 59 returns the sheet that passed through the fixing unit 9 to the upstream of the pair of the paper stop rollers 60, located upstream of the secondary transfer roller 8. The return conveyance path 59 is also comprised of guide plates and pairs of rollers for guiding and conveying the print sheets, as well as sensors installed at predetermined places to detect the position of the print sheet.

A sheet feeding tray 65 is provided below the toner storage unit 5 and above the sheet feeding cassette 52, forming the front wall of the device. The lower end of the sheet feeding tray 65 is pivotally supported in the vicinity of the curved path 55*a* of the first conveyance path 55 such that the sheet feeding tray 65 can be rotatably supported, to open and close freely. The upper end of the sheet feeding tray 65 can be reclined toward the front side of the device around a rotation center 65*a* in the lower end. Accordingly, when the sheet feeding tray 65 is opened, it is possible to put print sheets on the sheet feeding tray 65 and supply the curved path 55*a* of the first conveyance path 55 with the print sheets.

Toner Cartridge

In this embodiment, since the fundamental structure of the toner cartridges are the same, the structure of the toner cartridge 5*b* that contains black toner will be described in detail below, referring to figures starting from FIG. 3.

The toner cartridge 5*b* can be installed in or removed from the main body of the color printer 1 by sliding it in a substantially horizontal direction. The toner cartridge 5*b* is composed of a container main body 70 for containing toner in the interior thereof, a shutter mechanism 71, a lever 72 to operate the shutter mechanism 71, a lever locking mechanism 73 to lock the lever 72, a lock releasing mechanism 74 (FIG. 8) to release the locking of the lever 72 by the lever locking mechanism 73, and a prevention mechanism 75, see FIG. 9.

Container Main Body

Figure 3:
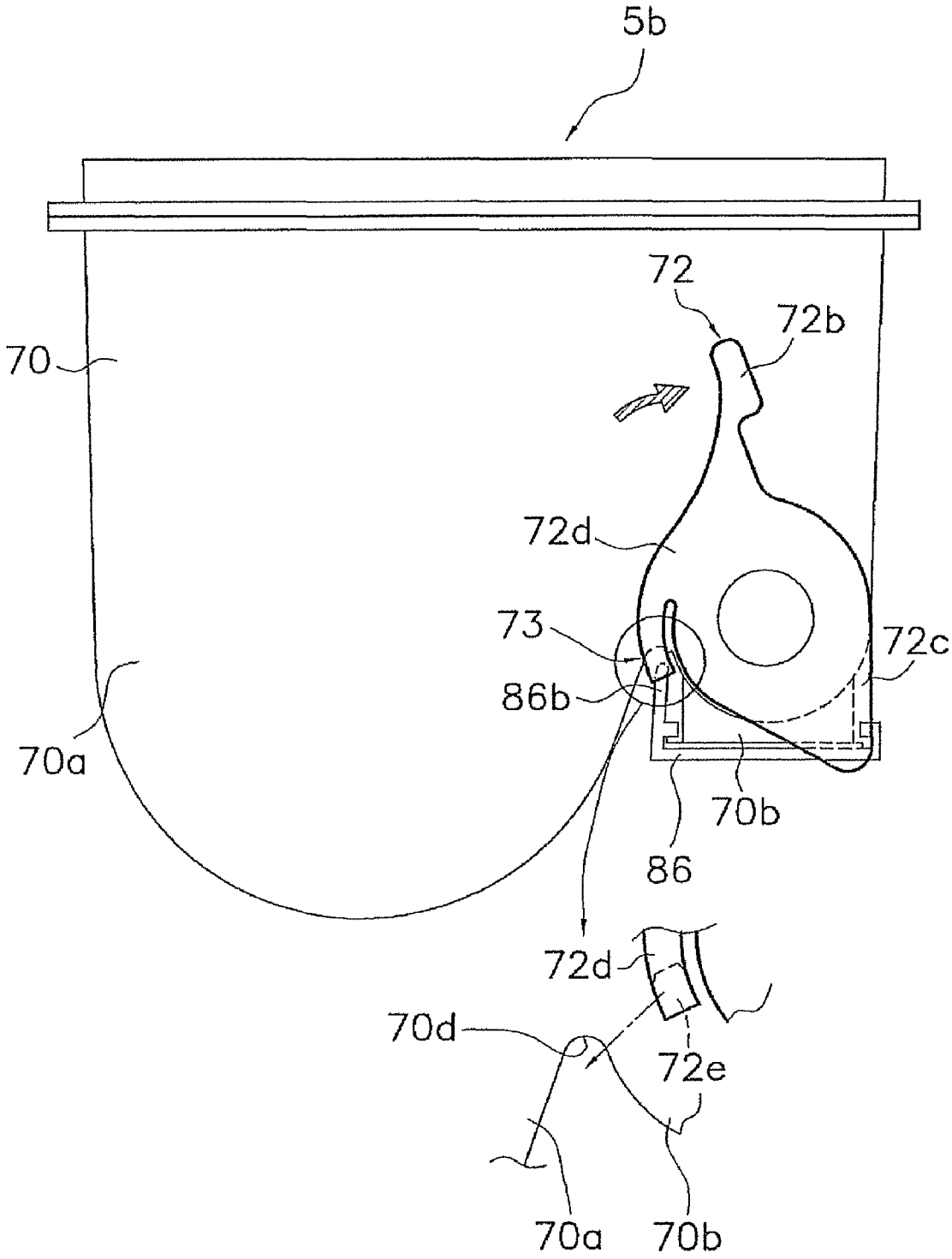
FIG. 3 is a front view of a toner cartridge.
Figure 4:
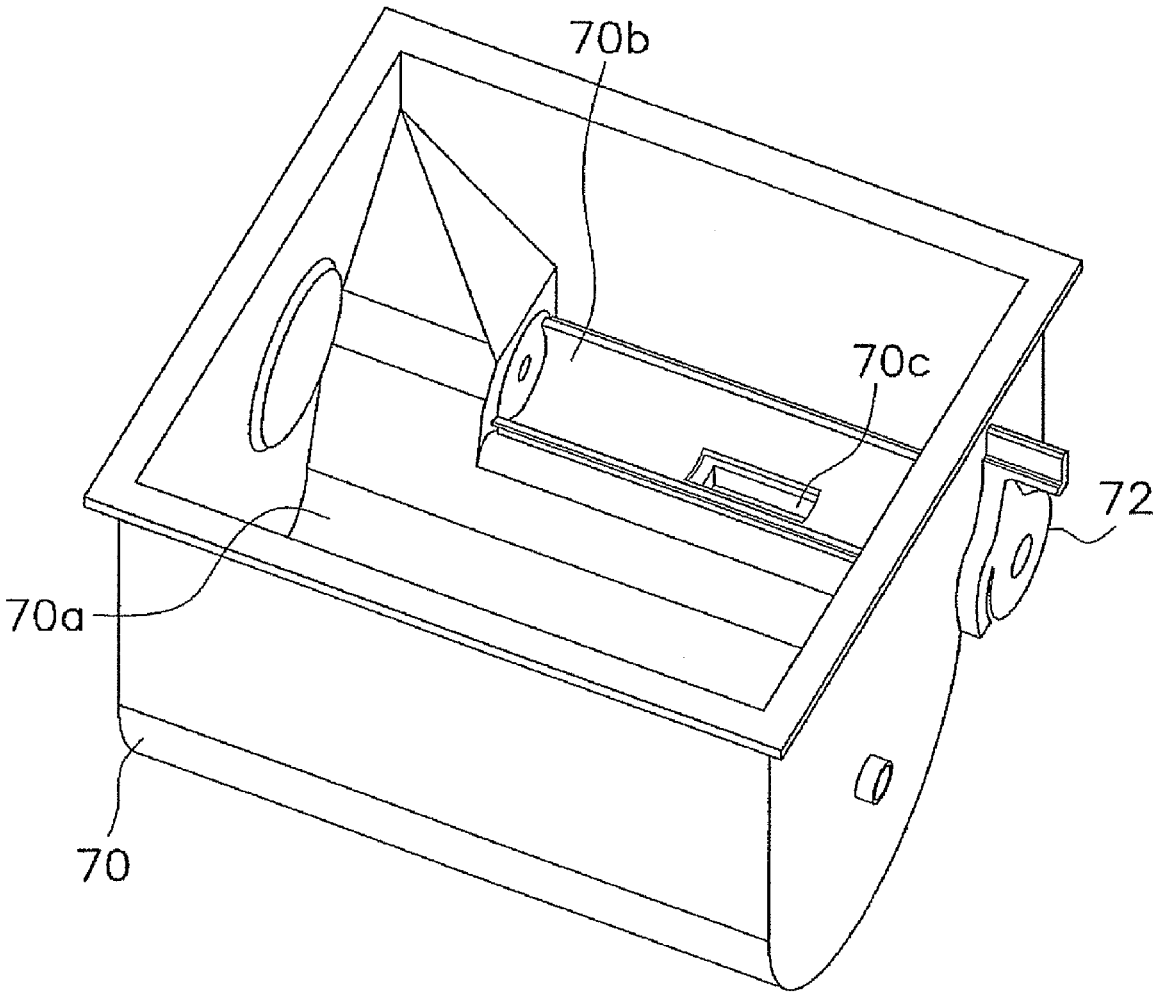
FIG. 4 is a perspective view of the inside of a container main body of a toner cartridge.

As shown in FIG. 3 and FIG. 4, with FIG. 4 showing the cover thereof removed, the container main body 70 is a box-like container composed of a storage portion 70*a* with a bottom face in a semi-circular shape in cross section, and a supply portion 70*b* adjacent to the storage portion 70*a* and shallower than the storage portion 70*a*. Note that the storage portion 70*a* is provided with a toner agitation member, not shown in the figures, and the supply portion 70*b* is provided with a toner conveyance screw. The supply portion 70*b* is provided with a toner outlet 70*c* at the bottom for supplying toner to the corresponding sub rotary developing unit 16. Moreover, a groove 70*d* is formed in an upside down U shape between the storage portion 70*a* and the supply portion 70*b*, as shown in the partially enlarged and exploded view in FIG. 3, seen from outside of the container main body 70. The groove 70*d* serves as an engaging portion on the container main body, as will be described later.

Shutter Mechanism

Figure 5:
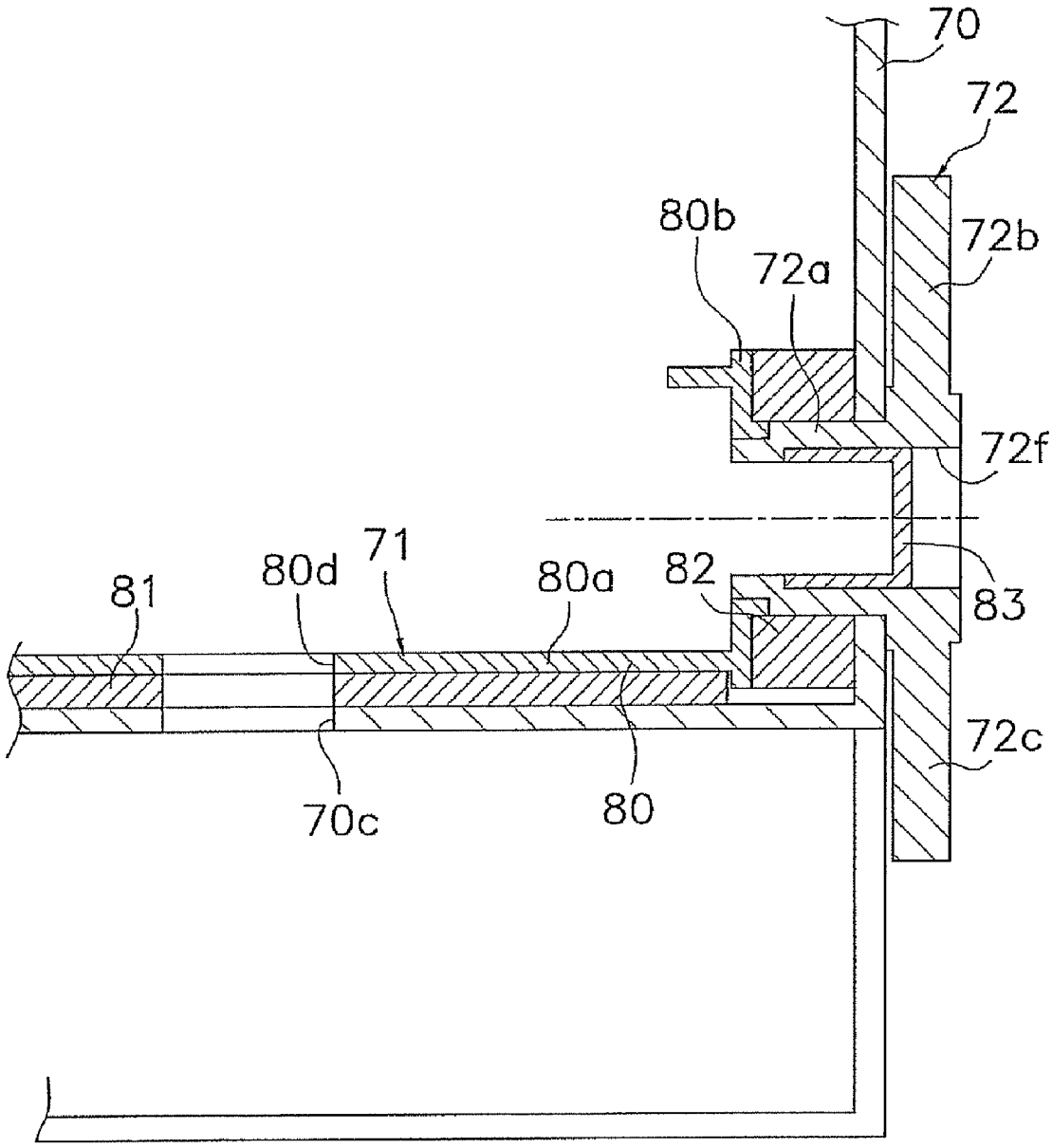
FIG. 5 is a fragmentary sectional view of a toner cartridge.
Figure 6:
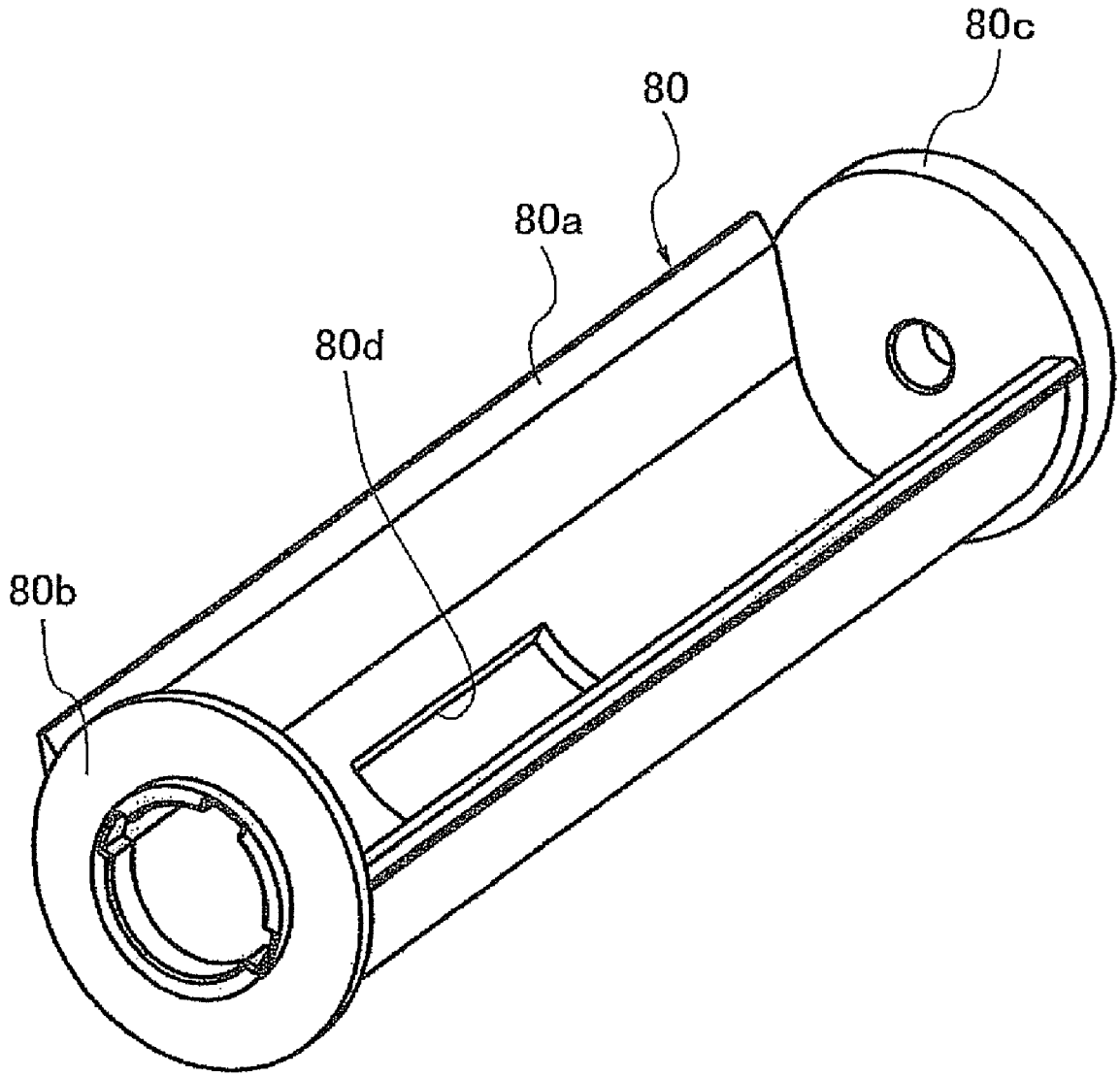
FIG. 6 is a perspective view of a rotary shutter.
Figure 7A:
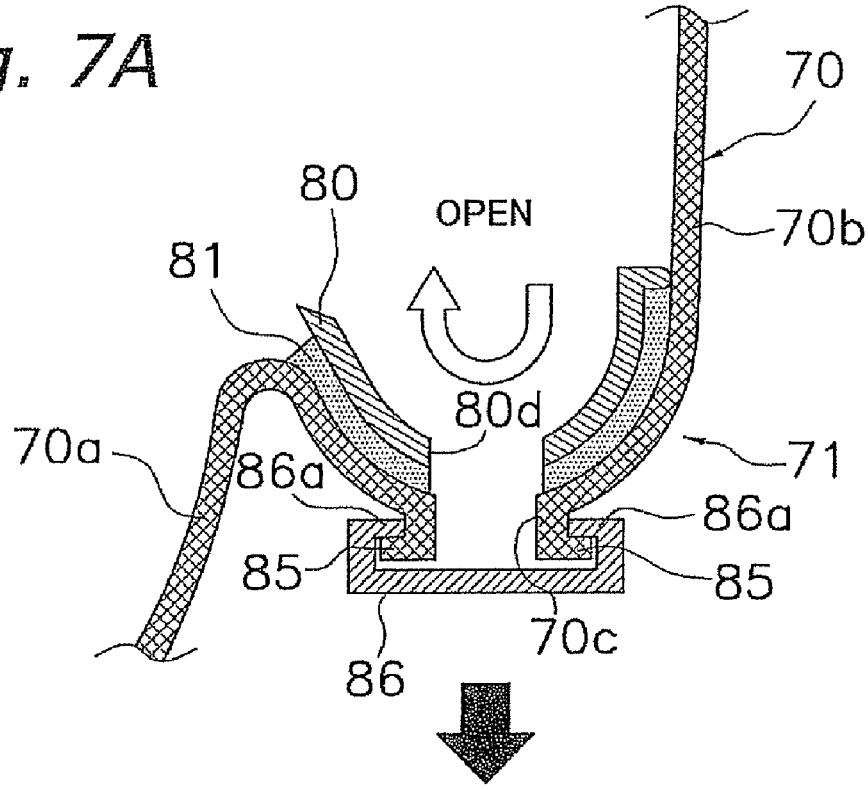
FIGS. 7A and 7B show the operation of a shutter mechanism.
Figure 7B:
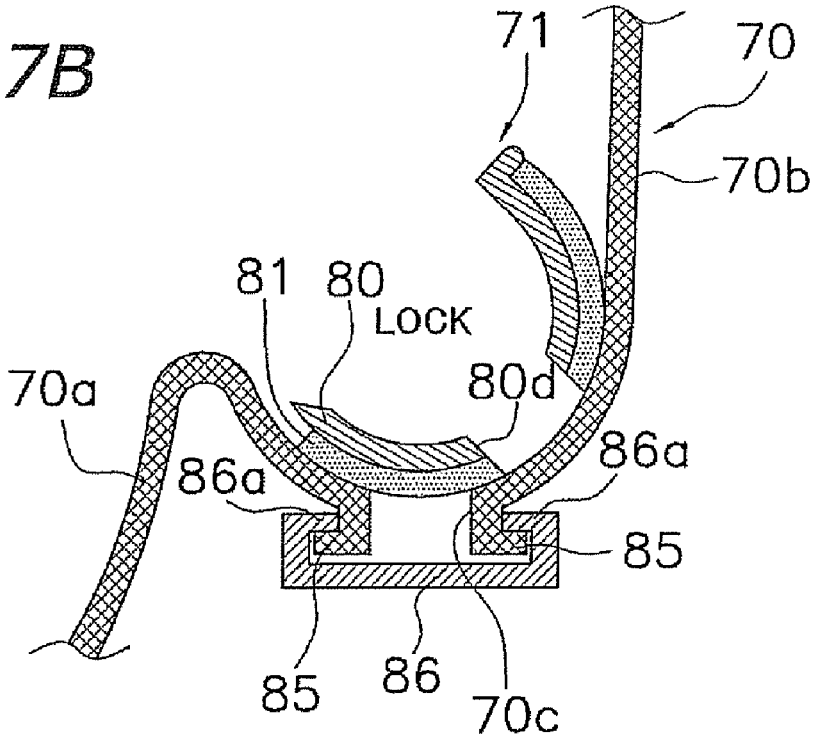

The shutter mechanism 71 is a mechanism to open and close the toner outlet 70*c* of the container main body 70, and has a rotary shutter 80 as shown in FIG. 5 and FIG. 6. The rotary shutter 80 is composed of a shutter 80*a* having a bottom in a rounded shape that conforms to the shape of the bottom of the supply portion 70*b*, and flanges 80*b* and 80*c* on both sides having a circular shape. Roughly the upper half of the shutter 80*a* is open, and the shutter 80*a* has a shutter opening 80*d* at the bottom in a position corresponding to the toner outlet 70*c*. The opening area of the shutter opening 80*d* is preferably equal to or slightly larger than the toner outlet 70*c*. The rotary shutter 80 is rotatably supported by the supply portion 70*b*. In between the rotary shutter 80 and the supply portion 70*b* is provided a seal member 81 to prevent the leakage of toner. In this structure, when the rotary shutter 80 rotates such that, as shown in FIG. 7A, when the shutter opening 80*d* of the rotary shutter 80 and the toner outlet 70*c* of the container main body 70 are aligned, the toner outlet 70*c* is opened, i.e., the shutter mechanism opened. On the other hand, as shown in FIG. 7B, when the angular positions of both are misaligned, the toner outlet 70*c* is closed, i.e., the shutter mechanism closed.

Lever

The lever 72 is, as shown in FIG. 5, rotatably supported on a side surface of the container main body 70 on the front side in the device. More precisely, it is rotatably supported on a side surface of the supply portion 70*b*. The lever 72 has a cylindrical support portion 72*a*, an operation portion 72*b* at one axis end of the support portion 72*a* extending in a radial direction, and a locking member 72*c* (a second engaging portion on the lever) extending in a direction opposite the operation portion 72*b*. The other end of the support portion 72*a* is inserted into a hole on the flange 80*b* of the rotary shutter 80 such that both members are connected non-rotatably. In addition, as shown in FIG. 3, an elastically deformable portion 72*d* is formed contiguously with the operation portion 72*b*. The elastically deformable portion 72*d* extends in a direction opposite to the operation portion 72*b* radially outside the periphery of the support portion 72*a*. The elastically deformable portion 72*d* is a slim strip. Therefore, it is possible to deform the portion 72*d* elastically simply by applying a force in the axial direction to the lower end of the portion 72*d*. At the lower end of the elastically deformable portion 72*d* is a protrusion 72*e* (a first engaging portion on the lever) projecting toward the container main body 70. The protrusion 72*e* can be engaged with the groove 70*d* in the container main body 70 (an engaging portion on the container main body), and can also be released from the groove 70*d* when the elastically deformable portion 72*d* is deformed to an extent away from the container main body 70. At the lever 72 end, a seal 82 is provided between the flange 80*b* of the rotary shutter 80 and the side wall of the container main body 70 to prevent the leakage of toner. A through hole 72*f* is formed on the center of the lever 72, where a cap 83 is fitted.

Lever Locking Mechanism

In the above-mentioned structure, the lever 72 is pivoted counterclockwise, which allows the rotary shutter 80 to adopt the posture shown in FIG. 7B. When the shutter mechanism 71 is closed, as shown in FIG. 3, the protrusion 72*e* of the lever 72 is locked in with the groove 70*d* of the container main body 70. As a result, the lever 72 is locked and can not be turned. In other words, the protrusion 72*e* and the groove 70*d* constitute the lever locking mechanism 73.

Lock Releasing Mechanism

At the bottom of the supply portion 70*b* of the container main body 70 are slide guides 85 projecting in a lateral direction, as shown in FIG. 7. A slide shutter 86 is slidably engaged with the slide guides 85. The slide shutter 86 has a closed lower surface and an open upper surface. On a part of the upper surface, guides 86*a* project a predetermined amount from both sides inward, the guides 86*a* being engaged with the slide guides 85 allowing the slide shutter 86 to slide. As shown in FIG. 3, a pressing portion 86*b* on a part of the slide shutter 86 projects upward, where the upper end is positioned at the same height in the vertical direction with the protrusion 72*e* of the elastically deformable portion 72*d* on the lever 72.

Figure 8:
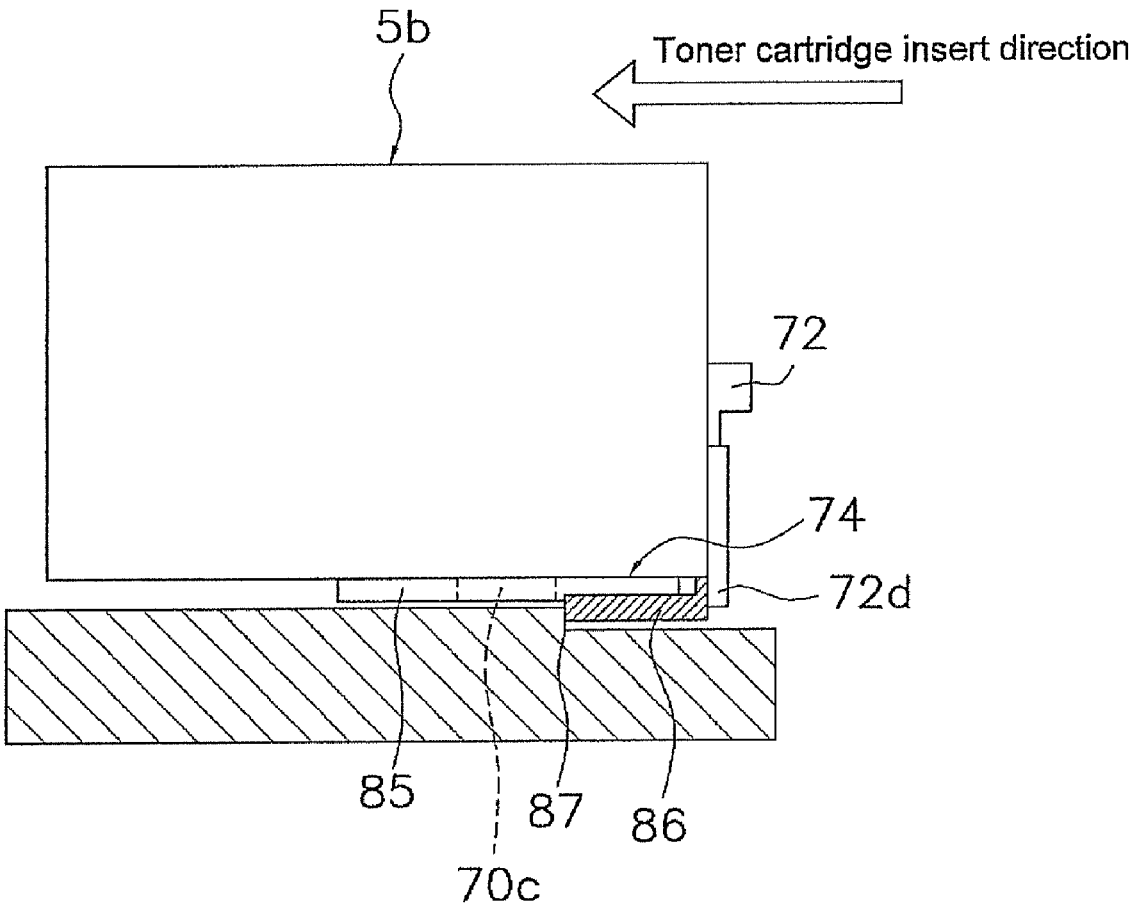
FIG. 8 shows the operation of a slide shutter.

On the side of the color printer 1, as shown in FIG. 8, a step portion 87 is formed below the toner cartridge 5*b*. The step portion 87 has a positional relationship such that when installing or removing the toner cartridge 5*b*, the step portion 87 is not in contact with the toner cartridge 5*b* itself, but is brought into contact with the slide shutter 86.

In the above-mentioned structure, when the toner cartridge 5*b* is installed into the color printer 1, the slide shutter 86 slides to elastically deform the elastically deformable portion 72*d* of the lever 72 in conjunction with the setting operation, thereby releasing the engagement between the lever 72 and the container main body 70. In other words, the lever 72 is unlocked. The details will be described below.

Prevention Mechanism

Figure 9:
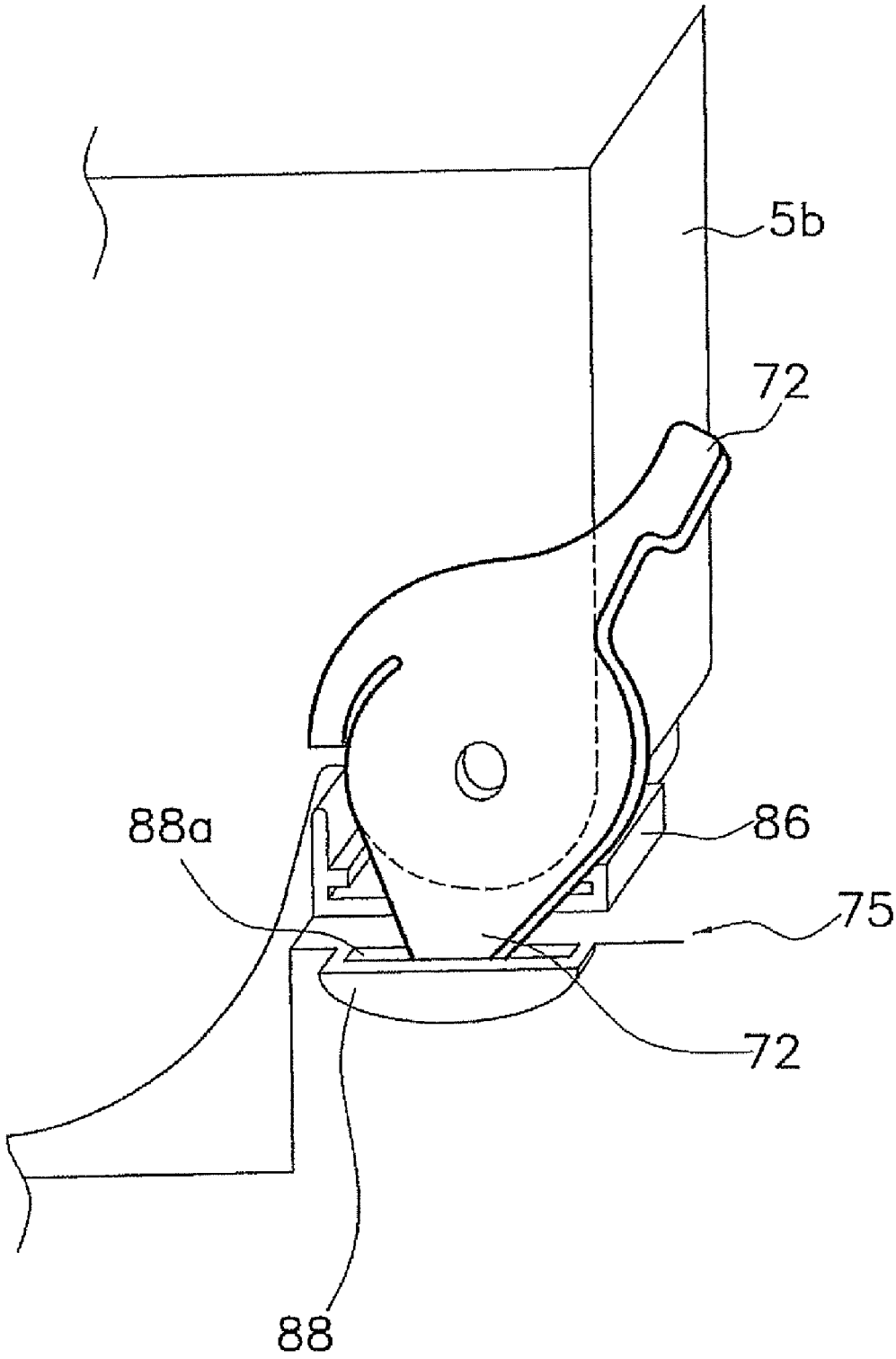
FIG. 9 shows the operation of a prevention mechanism.

As shown in FIG. 9, on the front side of the color printer 1 is a locking member 88 on the device side in a position corresponding to the lever 72 of the toner cartridge 5*b*, set in the normal position. The locking member 88 on the device side has a slot 88*a* (an engaging portion on the image forming device) at the top thereof. When the lever 72 is pivoted clockwise to allow the shutter mechanism 71 to open, the locking member 72*c* of the lever 72 is engaged with the slot 88*a*.

Accordingly, while the toner cartridge is set in its regular position and the shutter mechanism 71 opens the toner outlet 70*c*, the locking member 72*c* of the lever 72 and the slot 88*a* of the locking member 88 on the device are engaged, thereby preventing the toner cartridge from being removed.

Image Forming Operation

Next, the image forming operation will be explained in a simplified manner. First, when the power of the color printer 1 is turned on, a variety of parameters are initialized and initialization is executed such as setting the temperature of the fixing unit. When the printer receives a command to print an image data received from a computer connected to the printer, the image forming operation is carried out as follows. Note that during the image forming operation, the toner supply pipes 25 are moved to the retracted position upward.

First, the charge roller 10 charges the photosensitive drum 2. After that, the laser unit 4 scans and exposes the photosensitive drum 2 based on the image data to form an electrostatic latent image on the photosensitive drum 2. Next, the rotary developing unit 3 is rotated to a position that a sub rotary developing unit 16 with the designated color is facing the photosensitive drum 2. Here, the electrostatic latent image on the photosensitive drum 2 is developed with the designated toner color. The developed image is transferred onto the intermediate transfer belt 7. The above-mentioned operation is sequentially carried out color by color so that the full color image is formed on the intermediate transfer belt 7. Note that residual toner on the photosensitive drum 2 is cleaned by the drum cleaning unit 11 and discarded into a waste toner container (not shown in the figures).

In the sheet feeding unit 51, a sheet is taken out from the sheet feeding cassette 52 by the forward feeding roller 53 and the sheet feeding control mechanism 54, and conveyed to the pair of the paper stop rollers 60 through the first conveyance path 55. Then, the sheet is conveyed from the pair of the paper stop rollers 60 to the intermediate transfer belt 7 according to the timing of image forming thereon and guided to the secondary transfer roller 8. The secondary transfer roller 8 is in contact with the intermediate transfer belt 7, and the full color image formed on the intermediate transfer belt 7 is transferred to the sheet by applying transfer bias to the secondary transfer roller 8. The sheet is guided to the fixing unit 9 through the second conveyance path 56, and the image is fixed onto the sheet by heat and pressure in the fixing unit 9. In the case of a single-sided printing, the sheet is guided to the third conveyance path 57 by the branching claw 58, and discharged onto the sheet receiving portion 50.

In the case of dual-sided printing, after the image is fixed in the fixing unit 9, the sheet is temporarily conveyed toward the third conveyance path 57. When the trailing edge of the sheet passed by the branching claw 58, it is conveyed in a reverse direction, guided to the return conveyance path 59, and returned to the first conveyance path 55 again through the return conveyance path 59. The sheet, returned to the first conveyance path 55, is temporarily stopped by the pair of the paper stop rollers 60. The sheet is hold by the pair of the paper stop rollers 60 and sent with precise timing toward the secondary transfer roller 8 after the image to be formed on the other side of the sheet is formed on the intermediate transfer belt 7. Note that the image forming process is the same process described previously. After that, the same operation is carried out and the sheet is guided toward the third conveyance path 57 by the branching claw 58 and discharged onto the sheet receiving portion 50.

Toner Supply Operation

When supplying toner to a sub rotary developing unit 16, the corresponding toner supply pipe 25 moves downward to the supply position. A motor, not shown in the figure, drives the pinion gear 33 with the gears so that the toner supply pipe 25 to which the rack 32 is fixed moves downward. Meanwhile, the toner from the toner storage unit 5 is conveyed to the toner supply pipe 25 through the conveyance pipe 26. The tip of the toner supply pipe 25 advances into the sub rotary developing unit 16 through a toner supply opening. In the downward movement of the toner supply pipe 25, the outer cylinder rotates relative to the inner cylinder in the toner supply pipe 25, so that when the tip of the toner supply pipe 25 advances into the sub rotary developing unit 16, the opening of the outer cylinder and the opening of the inner cylinder are aligned with each other. That is, the shutter mechanism is opened so that the toner inside the toner supply pipe 25 is supplied into the sub rotary developing unit 16.

When the Toner Cartridge is not Installed

When the toner cartridge is not installed in the main body of the color printer 1, as shown in FIG. 3, the lever 72 is positioned in the closed shutter position. Here, the rotary shutter 80 is positioned in the angular position as shown in FIG. 7B, the shutter opening 80*d* of the rotary shutter 80 is not aligned with the toner outlet 70*c*. In addition, the slide shutter 86 is also positioned so as to cover the toner outlet 70*c*. Consequently, the leakage of toner is prevented. Moreover, in this state, the protrusion 72*e* on the elastically deformable portion 72*d* of the lever 72 is locked in with the groove 70*d* of the container main body 70, thereby prohibiting the lever 72 from pivoting. Therefore, even if the operation portion 72*b* of the lever 72 hits other members, the lever does not pivot, i.e., it is possible to prevent operating errors such as unintentional operation of the lever 72 which could cause the shutter mechanism 71 to open.

When the Toner Cartridge is Installed

When the toner cartridge is installed into the main body of the device, the slide shutter 86 is, in conjunction with the setting operation, brought into contact with the step portion 87 so that the slide shutter 86 is moved toward the front side of the device relatively. Accordingly, the slide shutter 86 has been moved forward, as shown in FIG. 8, from the position corresponding to the toner outlet 70*c*. At the same time, the upper end of the pressing portion 86*b* of the slide shutter 86 pushes the protrusion 72*e* of the elastically deformable portion 72*d* of the lever 72 outward. The elastically deformable portion 72*d* is elastically deformed so that the protrusion 72*e* is disengaged from the groove 70*d* to allow the lever 72 to pivot. Therefore, the operator can pivot the lever 72 clockwise in order to rotate the rotary shutter 80 into an angular position as shown in FIG. 7A, thereby opening the shutter mechanism 71. Consequently, the toner is supplied from the toner cartridge to the sub rotary developing unit.

On the other hand, when the lever 72 is pivoted clockwise to open the shutter mechanism 71, the locking member 72*c* of the lever 72 is engaged with the slot 88*a* of the locking member 88 on the device. The engagement between the locking member 72*c* of the lever 72 and the slot 88*a* of the locking member 88 on the device prevents the toner cartridge from being taken out. As a result, the toner cartridge with the shutter mechanism 71 open cannot be taken out of the main body of the device; therefore, toner does not leak out.

When removing the toner cartridge from the main body of the device, it is necessary to pivot the lever 72 counterclockwise so that the engagement between the locking member 72*c* of the lever 72 and the slot 88*a* of the locking member 88 on the device can be released. By doing so, the rotary shutter 80 is pivoted into an angular position shown in FIG. 7B where the shutter mechanism 71 is closed. Accordingly, when the toner cartridge is taken out of the main body of the device, toner does not leak out from the toner outlet 70*c*.

Second Embodiment

Figure 10B:
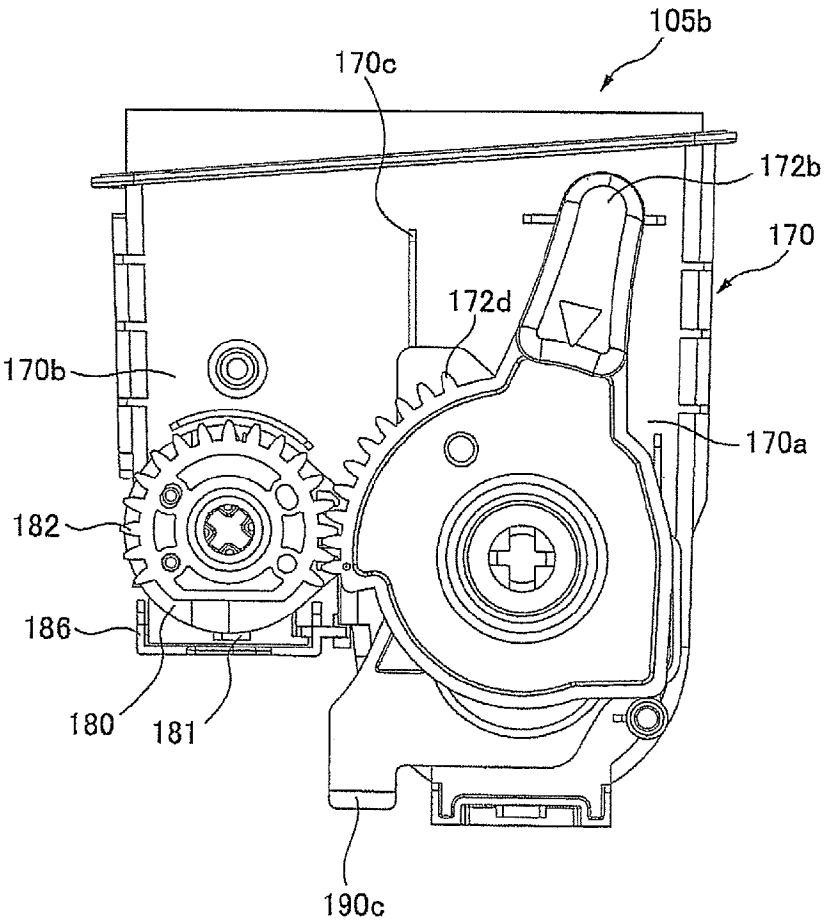
FIGS. 10A and 10B are front views of a toner cartridge according to a second embodiment of the present invention.
Figure 10A:
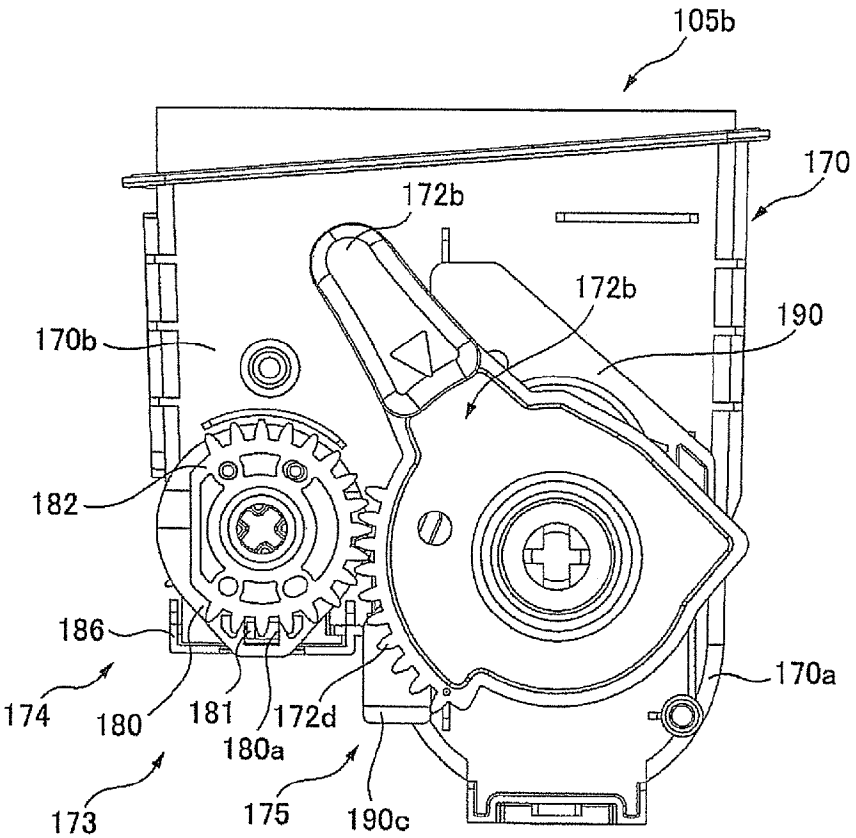
Figure 11:
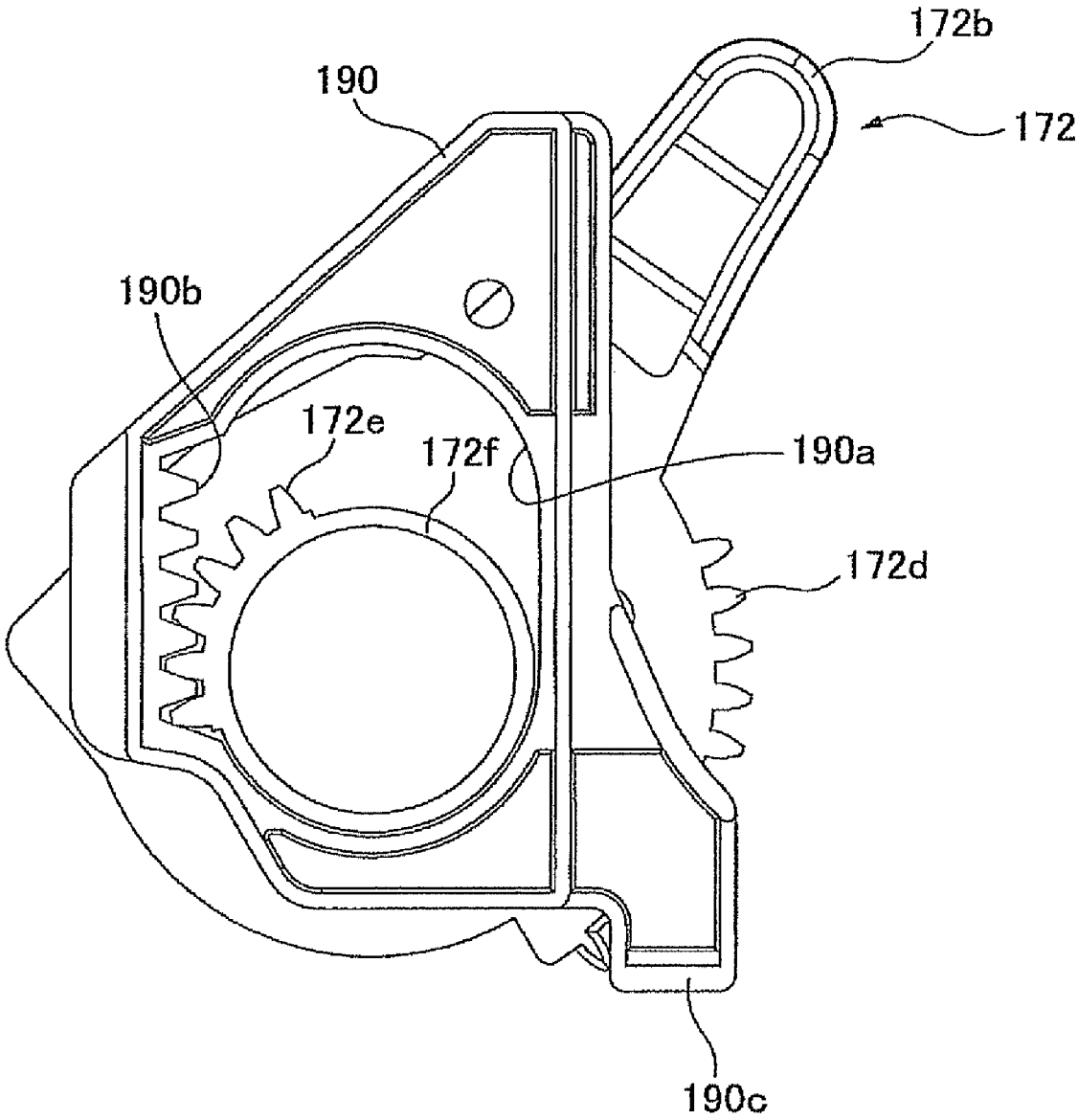
FIG. 11 shows a prevention mechanism of the toner cartridge in FIG. 10A and FIG. 10B.

A second embodiment of the present invention is shown in FIGS. 10A, 10B, and 11. In the second embodiment, since only the toner cartridge is different from the first embodiment, and the other structures are the same, a description will be made only on the toner cartridge hereinafter.

Toner Cartridge

All of the toner cartridges have the same fundamental structure. In this embodiment, the toner cartridge 105*b* that contains black toner will be described in detail referring to FIGS. 10A, 10B, and 11.

The toner cartridge 105*b* can be installed in or removed from the main body of the color printer 1 with a sliding movement in nearly a horizontal direction. The toner cartridge 105*b* is composed of a container main body 170 to contain toner inside, a shutter mechanism, a lever 172 to operate the shutter mechanism, a lever locking mechanism 173 for locking the lever 172 to be inoperative, a lock releasing mechanism 174 to release the lock on the lever 172 by the lever locking mechanism 173, and a prevention mechanism 175. Note that a detailed description on the shutter mechanism will be omitted because it is the same as the shutter mechanism in the first embodiment.

Container Main Body

The container main body 170 is a box-like container composed of a storage portion 170*a* with a bottom face in a semi-circular shape in cross section, and a supply portion 170*b* adjacent to the storage portion 170*a*, and shallower than the storage portion 170*a*. Note that, not shown in the figure, the storage portion 170*a* has a toner agitation member, and the supply portion 170*b* has a toner conveyance screw. The supply portion 170*b* has a toner outlet at the bottom (not shown in the figure) for supplying toner to the sub rotary developing unit 16, same as the first embodiment.

Outside the container main body 170, not shown in FIGS. 10A and 10B, gears, (even more to the front side than the lever 172 and other members shown in FIG. 10) are provided for driving the toner agitation member and the toner conveyance screw.

Lever

The lever 172 is rotatably supported on the surface on the front side of the device of the container main body 170, and includes an operation portion 172*b* extending upward, and a first gear 172*d* formed on the outer circumference of an arcuate portion centered around the rotational axis.

Lever Locking Mechanism

The lever locking mechanism 173 includes a lock plate 180 rotatably supported on the surface on the front side of the device of the supply portion 170*b* of the container main body 170, a protrusion 181 formed on the container main body 170, and a gear 182 for locking and unlocking.

The lock plate 180 is a plate of approximately circular shape, and has a projection on the outer circumference in which a rectangular engagement hole 180*a* is formed, see FIG. 10A. Approximately half of the lock plate 180 on the side with the projection on the outer circumference is formed thinner than the other half so as to be more elastically deformable.

The protrusion 181 protrudes out on the surface on the front side of the device of the supply portion 170*b* of the container main body 170, able to engage with the engagement hole 180*a* of the lock plate 180. The rotation prevention mechanism includes the lock plate 180 having the engagement hole, the lock plate being coaxial with the gear and attached to the gear unrotatably, and the protrusion 181 formed on the container main body which can be engaged with the engagement hole 180*a* of the lock plate 180.

The gear 182 is located outward of the lock plate 180 and attached to the lock plate 180 unrotatably such that the gear rotates together with the lock plate 180. The gear 182 is engaged with the first gear 172*d* of the lever 172. The gear 182 is engaged with the rotary shutter 80 (refer to FIG. 5 and FIG. 6), which constitutes the shutter mechanism. Accordingly, when the gear 182 rotates, the rotary shutter 80 is driven to rotate. As with the first embodiment, the shutter mechanism can be driven into an opened or a closed position, see FIG. 7A and FIG. 7B.

In the above-mentioned structure, as shown in FIG. 10A, when the lever 172 is pivoted counterclockwise, the protrusion 181 of the container main body 170 locks in the engagement hole 180*a* of the lock plate 180. As a result, the lock plate 180 and the gear 182 are prohibited from pivoting, and in turn the lever 172, having the first gear 172*d* engaged with the gear 182, is prohibited from rotating, i.e., is locked.

Lock Releasing Mechanism

A slide shutter 186 is slidably attached to the bottom of the supply portion 170*b* of the container main body 170, as with the first embodiment. Although the specific configuration of the slide shutter 186 is different from the slide shutter in the first embodiment, the basic structure is the same. Therefore, a detailed description will be omitted.

Meanwhile, the structure of the color printer 1 is the same as the one in the first embodiment. In other words, as shown in FIG. 8, the step portion 87 is formed at the bottom of the toner cartridge 105*b*. The step portion 87 has a positional relationship such that when installing or removing the toner cartridge 105*b*, the step portion 87 is not in contact with the toner cartridge 105*b* itself, but is brought into contact with the slide shutter 186.

Prevention Mechanism

The prevention mechanism 175 has, as shown in FIG. 1I that shows the lever 172 seen from inside the container main body, a second gear 172*e* on the back surface (container main body side) of the lever 172, and a slide plate 190.

The second gear 172*e* is formed on a part of the outer circumference of a cylinder 172*f* having a center on the pivoting axis of the lever 172. The second gear 172*e* and the cylinder 172*f* are formed integrally with the lever 172.

The slide plate 190 is a plate having an opening 190*a* approximately in the center. It is located between the lever 172 and the container main body 170. The slide plate 190 can move in the vertical direction along a slide guide 170*c* (refer to FIG. 10B) on the wall surface of the container main body 170. The cylinder 172*f* and the second gear 172*e* of the lever 172 are inserted into the opening 190*a* of the slide plate 190. A gear (rack) 190*b* extending straight in the vertical direction is formed on the periphery of the opening 190*a* facing the second gear 172*e*. A locking portion 190*c* extends downward from the lower end of the slide plate 190 near the gear 182.

Meanwhile, as shown in FIG. 9, on the front side of the color printer 1, a locking member 88 is formed on the device, in a position corresponding to the lever 172 of the toner cartridge 105*b* set in the normal position, same as the first embodiment. The locking member 88 on the device has the same structure as the one in the first embodiment, and has a slot 88*a* (an engaging portion on the image forming device) on the top.

When the Toner Cartridge is not Installed

When the toner cartridge is not installed in the main body of the color printer 1, as shown in FIG. 10A, the lever 172 is positioned in the closed shutter position. Here, the rotary shutter 80 is positioned in the angular position as shown in FIG. 7B so that the shutter opening 80*d* of the rotary shutter 80 is not aligned with the toner outlet. In addition, the slide shutter 186 is also positioned so as to cover the toner outlet. Consequently, the leakage of toner is prevented. Moreover, in this state, the protrusion 181 on the container main body is locked in with the engagement hole 180*a* of the lock plate 180 so that the lock plate 180, the gear 182 and the lever 172 engaged with the gear 182 are prohibited from rotating, i.e., can not be operated. As a result, even if the operation portion 172*b* of the lever 172 hits other members, the lever 172 does not pivot, i.e., it is possible to prevent operating errors such as unintentional operation of the lever 172 which could cause the shutter mechanism to open.

When the Toner Cartridge is Installed

When the toner cartridge is installed into the device main body, the slide shutter 186 is brought into contact with the step portion 87 so that the slide shutter 186 is moved toward the front side of the device relatively, in conjunction with the installment of the toner cartridge. Accordingly, the slide shutter 186 has been moved, from the position corresponding to the toner outlet. The end of the slide shutter 186 pushes the projection on the outer circumference of the lock plate 180 outward. The projection on the outer circumference of the lock plate 180 is elastically deformed outward so that the engagement between the engagement hole 180*a* of the lock plate 180 and the protrusion 181 is released. In this state, the lock plate 180 and the gear 182 are allowed to rotate, and the lever 172 can be operated. Therefore, the operator can rotate the lever 172 into an angular position as shown in FIG. 7A to pivot the rotary shutter 80 clockwise, thereby open the shutter mechanism. Consequently, the toner is supplied from the toner cartridge to the sub rotary developing unit.

On the other hand, when the lever 172 is pivoted clockwise to open the shutter mechanism, since the second gear 172*e* of the lever 172 is engaged with the rack 190*b* of the slide plate 190, the slide plate 190 moves downward as the pivot operation of the lever 172 proceeds, and finally the locking portion 190*c* of the slide plate 190 is engaged with the slot 88*a* of the locking member 88 on the device. As a result, the engagement between the locking portion 190*c* of the slide plate 190 and the slot 88*a* of the locking member 88 on the device prevents the toner cartridge from being taken out. As a result, the toner cartridge with the shutter mechanism open cannot be taken out of the main body of the device, thereby preventing the leakage of toner.

When the toner cartridge is taken out of the main body of the device, the lever 172 is pivoted counterclockwise to move up the slide plate 190 as the pivoting operation proceeds. As a result, the engagement between the locking portion 190*c* of the slide plate 190 and the slot 88*a* of the locking member 88 on the device is released.

As the releasing operation of the engagement between both members proceeds, the gear 182 rotates to drive the rotary shutter 80 to an angular position as shown in FIG. 7B, thereby closing the shutter mechanism 71. As a result, when the toner cartridge is removed from the image forming device, toner does not leak out from the toner outlet.

General Interpretation of Terms

In understanding the scope of the present invention, the term "configured" as used herein to describe a component, section or part of a device includes hardware and/or software that is constructed and/or programmed to carry out the desired function. In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A toner cartridge removably attached to an image forming device, the toner cartridge comprising:

a container main body configured to contain toner and having a toner outlet;

a lever rotatably supported by the container main body and configured to operate a shutter mechanism that opens and closes the toner outlet of the container main body, the shutter mechanism includes a gear that is rotatable around an axis different from a pivot axis of the lever and rotates in conjunction with the shutter mechanism and the lever;

a lever locking mechanism configured to lock the lever so as to be inoperative while the toner outlet is closed by way of the shutter mechanism;

a lock releasing mechanism configured to unlock the lever which is locked by the lever locking mechanism in conjunction with installation of the container main body in the image forming device; and a prevention mechanism configured to prevent the container main body from being taken out of the image forming device while the container main body is installed in the image forming device and the toner outlet is open.

2. The toner cartridge according to claim 1, wherein the lever locking mechanism including a first engaging portion and an engaging portion formed in the container main body with which the first engaging portion is arranged to engage.

3. The toner cartridge according to claim 2, further comprising a slide shutter slidably arranged in the path of insertion of the toner cartridge, the slide shutter being adapted to open and close the toner outlet together with the shutter mechanism, the lock releasing mechanism having:

the slide shutter; and a step portion formed on the image forming device that abuts against the slide shutter and slides the slide shutter toward the lever in order to move the first engaging portion on the lever in conjunction with installation of the container main body into the image forming device, and thereby releases the engagement between the first engaging portion on the lever and the engaging portion on the container main body.

4. The toner cartridge according to claim 2, wherein the first engaging portion is a protrusion projecting towards the container main body and the engaging portion of the container main body is a groove, the protrusion being releasably engaged with the groove.

5. The toner cartridge according to claim 1, wherein the prevention mechanism including a second engaging portion formed on the lever, and an engaging portion formed on the image forming device, the engagement portion on the image forming device being arranged to engage the second engaging portion to prevent the container main body from being taken out of the image forming device while the toner outlet is opened.

6. The toner cartridge according to claim 1, further comprising a rotation prevention mechanism with a lock plate having an engagement hole formed therein, and a protrusion formed on the container main body which can engage with engagement hole of the lock plate.

7. The toner cartridge according to claim 6, further comprising a slide shutter slidably arranged in the path of insertion of the toner cartridge, and configured to open and close the toner outlet together with the shutter mechanism, the lock releasing mechanism having:

the slide shutter; and a step portion formed on the image forming device that abuts against the slide shutter and slides the slide shutter toward the lock plate in order to elastically deform the portion of the lock plate in which the engagement hole is formed, in conjunction with installation of the container main body to the image forming device, and thereby releases the engagement between the lock plate the engagement hole and the protrusion.

8. The toner cartridge according to claim 1, wherein the prevention mechanism including a slide plate having an engaging portion, the slide plate being configured to slide in conjunction with pivoting of the lever; and an engaging portion formed on the image forming device that is configured to engage with the engaging portion on the slide plate in order to prevent the container main body from being taken out of the image forming device while the toner outlet is opened.

9. A shutter structure of a toner cartridge which is removably attached to an image forming device, the shutter structure comprising:

a lever rotatably supported by a container main body of the toner cartridge and configured to operate a shutter mechanism that opens and closes a toner outlet of the toner cartridge, the shutter mechanism includes a gear that is rotatable around an axis different from a pivot axis of the lever and rotates in conjunction with the shutter mechanism and the lever;

a lever locking mechanism configured to lock the lever so as to be inoperative while the toner outlet is closed by means of the shutter mechanism;

a lock releasing mechanism configured to unlock the lever which is locked by the lever locking mechanism when the container main body is installed into the image forming device; and a prevention mechanism configured to prevent the container main body from being taken out of the image forming device while the container main body is installed in the image forming device and the toner outlet is open.

10. An image forming device, comprising:

an image forming unit; and a toner cartridge removably attached to the image forming unit and includes a container main body constructed to contain toner and having a toner outlet, a lever pivotally coupled to the container main body and arranged to operate a shutter mechanism that opens and closes the toner outlet, the shutter mechanism includes a gear that is rotatable around an axis different from a pivot axis of the lever and rotate in conjunction with the shutter mechanism and the lever, a lever locking mechanism configured to lock the lever so as to be inoperative while the toner outlet is closed by way of the shutter mechanism, a lock releasing mechanism configured to unlock the lever which is locked by the lever locking mechanism when the container main body is installed in the image forming device, and a prevention mechanism configured to prevent the container main body from being taken out of the image forming device while the container main body is installed in the image forming device and the toner outlet is open.

* * * * *